US009030449B2

(12) United States Patent
Kobayashi et al.

(10) Patent No.: US 9,030,449 B2
(45) Date of Patent: May 12, 2015

(54) ELECTRO-OPTICAL DEVICE AND ELECTRONIC APPARATUS

(75) Inventors: Shinichi Kobayashi, Azumino (JP); Fusashi Kimura, Matsumoto (JP); Atsunari Tsuda, Suwa (JP); Yuki Okuhara, Azumino (JP)

(73) Assignee: Sony Corporation, Tokyo (JP)

( * ) Notice: Subject to any disclaimer, the term of this patent is extended or adjusted under 35 U.S.C. 154(b) by 1271 days.

(21) Appl. No.: 11/620,071

(22) Filed: Jan. 5, 2007

(65) Prior Publication Data

US 2007/0182727 A1 Aug. 9, 2007

(30) Foreign Application Priority Data

Feb. 9, 2006 (JP) ..... 2006-31953

(51) Int. Cl.
*G09G 5/00* (2006.01)
*G09G 3/36* (2006.01)

(52) U.S. Cl.
CPC ..... *G09G 3/3611* (2013.01); *G09G 2330/06* (2013.01); *G09G 2370/08* (2013.01)

(58) Field of Classification Search
CPC ..... G09G 3/3611; G09G 2370/08; G09G 2370/10; G09G 2370/16; G09G 1/1654
USPC ..... 345/204, 7–9, 98–100, 104, 211–213; 455/566, 346–349, 556.1, 556.2; 361/679.29
See application file for complete search history.

(56) References Cited

U.S. PATENT DOCUMENTS

| | | | | |
|---|---|---|---|---|
| 5,741,184 | A * | 4/1998 | Takemoto et al. | 463/43 |
| 5,751,773 | A * | 5/1998 | Campana, Jr. | 375/346 |
| 5,973,601 | A * | 10/1999 | Campana, Jr. | 340/573.4 |
| 6,009,336 | A * | 12/1999 | Harris et al. | 455/566 |
| 6,175,346 | B1 * | 1/2001 | Chiu et al. | 345/82 |
| 6,282,433 | B1 * | 8/2001 | Holshouser | 455/556.2 |
| 6,553,263 | B1 * | 4/2003 | Meadows et al. | 607/61 |
| 7,071,629 | B2 * | 7/2006 | Russ et al. | 315/169.3 |
| 7,170,870 | B2 * | 1/2007 | Rensberger et al. | 370/328 |
| 7,173,765 | B2 * | 2/2007 | Yamasaki | 359/630 |
| 7,286,904 | B2 * | 10/2007 | Graham | 700/284 |
| 7,460,085 | B2 | 12/2008 | Ishii | |
| 7,555,658 | B2 * | 6/2009 | Vahid et al. | 713/300 |
| 2002/0118156 | A1 * | 8/2002 | Naito | 345/87 |
| 2006/0124897 | A1 | 6/2006 | Shingai et al. | |

FOREIGN PATENT DOCUMENTS

| | | |
|---|---|---|
| JP | H05-14540 | 1/1993 |
| JP | 2003-333136 | 11/2003 |
| JP | 2005-031344 | 2/2005 |
| JP | 2005-250442 | 9/2005 |
| WO | 2005-024774 | 3/2005 |

* cited by examiner

*Primary Examiner* — Jimmy H Nguyen
(74) *Attorney, Agent, or Firm* — K&L Gates LLP

(57) ABSTRACT

An electro-optical device includes: a display portion that displays images; a power source portion; a converter that has an antenna receiving wireless signals including display controlling signals and image signals from the external based on a wireless transmission method and that converts the wireless signals received from the antenna into wire signals; and a driving circuit that is electrically connected to the power source portion and the converter, respectively, to display the images on the display portion based on the power supplied from the power source portion and the image signals and the display controlling signals output from the converter.

11 Claims, 9 Drawing Sheets

E1
81g
POWER SOURCE PORTION
62
81e
BASE BAND ENGINE
LIQUID CRYSTAL DRIVING CIRCUIT
81eb
61
DISPLAY INFORMATION OUTPUTTING CIRCUIT
81ea
60
81f
CONVERTER
63
81h
64
81
100
80
70
POWER SOURCE PORTION
65
80h
80f
CONVERTER
63
34
DRIVER IC
8
Gm
Gm-1
G2
G1
32
35
33
50
V

Y
X
50
3
V
SG
10
21
AG
8
IV
IV
38
38
32
32
31
31
7
72
92
70
POWER SOURCE PORTION
Gm-1
G3
G1
S1
S2
Sn-1
Sn
G2
G4
Gm
DRIVER IC
33
36
71
35
91
80h
CONVERTER
80f
35
34

<COMPARISON EXAMPLE>

ELECTRO-OPTICAL DEVICE AND ELECTRONIC APPARATUS

The entire disclosure of Japanese Patent Application No. 2006-031953, filed Feb. 9, 2006 is expressly incorporated by reference herein.

BACKGROUND

1. Technical Field

The present invention relates to an electro-optical device suitable for displaying a variety of information and an electronic apparatus using the same as a display unit.

2. Related Art

As a known example of an electro-optical device, a liquid crystal device is used for a display unit of a mobile terminal apparatus, such as a mobile phone.

Such a liquid crystal device is constituted by sandwiching liquid crystal between a pair of substrates. For example, in a liquid crystal device manufactured using an active matrix method, one substrate of a pair of substrates mainly comprises a data line, a switching element connected to the data line, a pixel electrode connected to the switching element, a driver IC that drives the pixel electrodes and the scan lines, and a flexible print board FPC connected to a controlling IC mounted on a mobile terminal apparatus and having a central processing unit (CPU) or a memory, etc. and the driver IC via the plurality of wirings, and the other substrate comprises scan lines and a color filter substrate.

Herein, the plurality of wirings comprises a plurality of display data supply wirings; various display control wirings that control signals such as horizontal synchronizing signals, vertical synchronizing signals, or dot clock signals; and power supply wirings, etc.

In the liquid crystal device having such a configuration, the controlling IC mounted on the mobile terminal apparatus supplies display data or power, etc. to the driver IC, for example, via the plurality of wirings and the FPC as an interface portion from a base band engine BBE, etc.

Also, as such a mobile terminal apparatus, for example, a very small and lightweight mobile terminal apparatus can be realized by installing bus transmitting control signals and a means for stopping the transmission of the control signals therein (for example, see JP-A-5-14540).

In the mobile terminal apparatus, the driver IC and the FPC are connected to each other via the plurality of wirings. For this reason, there are various constraints in designing the mobile terminal apparatus, such as a space for installing the plurality of wirings must be secured or the layout method of the plurality of wirings must be changed according to the specification or kind of mobile terminal apparatus, etc. Therefore, the degree of freedom of the design of the interface portion E2 is reduced and also it is difficult to realize miniaturization and weight reduction of the mobile terminal apparatus.

Further, since there are various different wirings or various different circuits in the mobile terminal apparatus, noises generated therefrom enter the plurality of wirings and therefore, there is considerable risk of not obtaining a desired image. That is, since the wirings exist between a plurality of other wirings or various circuits, interference problems due to noises occur.

Also, although the amount of wiring in the mobile terminal apparatus disclosed in JP A-5-14540 is significantly reduced as compared with the mobile terminal apparatus of related art cited in JPA-11-14540, the display unit and the controlling IC that controls the display unit are connected to each other via the plurality of wirings (that is, a control line, a data line, and an address line) and therefore, the problem described above still remains.

SUMMARY

An advantage of some aspects of the invention is that it provides an electro-optical device and an electronic apparatus having an interface portion of improved design and solving the above interference problems resulting from the noises involved in transmitting of signals.

An electro-optical device according to an aspect of the invention comprises a display portion that displays images; a power source portion; a converter that has an antenna receiving wireless signals including display controlling signals and image signals from the external, based on a wireless transmission method and that converts the wireless signals received from the antenna into wire signals; and a driving circuit that is electrically connected to the power source portion and the converter, respectively, to display the images on the display portion based on the power supplied from the power source portion and the image signals and the display controlling signals output from the converter.

The electro-optical device comprises: a display portion that displays images such as characters or figures, etc.; a power source portion; a converter that has an antenna receiving wireless signals including image signals corresponding to image data to be displayed, for example, from the external such as a controlling circuit (for example, a base band engine), etc. in an electronic apparatus and display controlling signals such as horizontal synchronizing signals, vertical synchronizing signals, or dot clock signals, etc., based on the wireless transmission method and that converts wireless signals received from the antenna into wire signals; and a driving circuit such as, for example, a driver IC, etc. that is electrically connected to the power source portion and the converter, respectively, to display the images on the display portion based on the power supplied from the power source portion and the image signals and the display controlling signals as the wire signals output from the converter.

Accordingly, the electro-optical device can output, based on the wireless transmission method, the image signals and the display controlling signals to the driving circuit by interposing the converter including the antenna at the outside thereof and supply the power from the power source portion to the driving circuit so that the driving circuit can display the images.

Since the converter (hereinafter, referred to as an interface portion) receiving the data is constituted by a wireless rather than by a wire, the interface portion can be implemented as a simple structure. That is, it is unnecessary to install the plurality of wires or a noise removing filter, etc. in the interface portion. Therefore, the degree of freedom of the design of the interface portion can be improved as well as the degree of freedom of the design of the electro-optical device can be improved. Consequently, the miniaturization and lightweight of the electro-optical device can very readily be achieved.

As an appropriate example, the power source portion may comprise: a power source that can readily be charged by a contact-less type charging method according to the known electromagnetic induction; and a power supply circuit that supplies power obtainable from the power source to the converter and the driving circuit. Further, a setting position of the power source portion in the electro-optical device is not limited. For example, if an electro-optical panel comprises an array substrate having data lines, switching elements, and pixel electrodes, and a substrate disposed to be opposite to the array substrate and having scan lines or a colored layer, and comprises a reflective display mode, etc., it is possible to arrange the power source portion in a position to be overlapped with an effective displaying region of the opposite substrate. Further, in the case of other kinds of electro-optical devices, it may be preferable that a thin power source portion (for example, a battery, etc.) is disposed on a position to be overlapped with the whole effective displaying region.

Also, as an appropriate example, the electro-optical device may comprise a plurality of first wires such as, for example, the data lines, etc. that are electrically connected to the driving circuit to output data signals from the driving circuit; a plurality of second wires such as, for example, the scan lines, etc. that are electrically connected to the driving circuit and extended and arranged in a direction to be intersected with the plurality of first wires to output scan signals from the driving circuit; and a plurality of pixel electrodes that are provided to correspond to the intersecting positions of the plurality of first wires and the plurality of second wires and electrically connected to the plurality of first wires, wherein the display portion corresponds to a region in which the plurality of unit pixel electrodes are provided.

The converter may have a function to convert other wire signals output from predetermined circuits to other wireless signals and a function to transmit the other wireless signals to the external via the antenna.

The converter may have a function to convert other wire signals output from predetermined circuits such as, for example, the driving circuit, etc. to other wireless signals. The converter has a function to transmit other wireless signals to the external such as, for example, the controlling circuit of the electronic apparatus (for example, a base band engine), etc. via the antenna. Therefore, according to this aspect, the converter can execute a two-way communication between the external and the predetermined circuits. Thereby, since the reliability (for example, existence of non-existence of errors) of data upon transceiving the data is investigated by the two-way communication to correct the error, etc., the reliability of communication can be improved. Further, since it has the transmitting function like this aspect, it can execute the transmission to the external such as, for example, other apparatuses including an electronic payment system, etc., as will be described below.

According to the aspect of the invention, the electro-optical device comprises a wiring board such as, for example, a flexible print board (FPC), etc. that is connected to the driving circuit, wherein the converter can be provided on the wiring board.

According to another aspect of the electro-optical device, the converter is included, as a circuit, in the driving circuit and the antenna is drawn out from the converter to the outside of the driving circuit. Also, according to another aspect of the electro-optical device, the driving circuit is provided on the board and the converter is included, as a circuit, in the driving circuit and the antenna is drawn out from the converter of the substrate or to a position near the driving circuit. Accordingly, since it is unnecessary to install the wiring board by the configuration as above, the degree of freedom of the design of the electro-optical device including the interface portion is further improved so that the miniaturization and lightweight of the electro-optical device can be realized.

According to another aspect of the electro-optical device, the wireless signal is received from the outside at the converter using some other frequency band (for example, frequency bands for a communication and a transmission and reception of a mail) that does not overlap a frequency band used for the external communication according to the wireless transmission method. Thereby, it is difficult that various unnecessary noises generated in the external enter the wireless signals such as the image data, etc. Also, in the case that the external is a body of a mobile phone, when the communication or the transmission and reception of the mail is executed using the body of the mobile phone while executing the reception of the image data between the body of the mobile phone and the converter, it can prevent unnecessary noises generated upon making the communication and the transmission and reception of the mail from entering the image data. Therefore, the interference problems due to the noises involved in the transmission of the signals such as the image data, etc, can be solved.

According to another aspect of the electro-optical device, the wireless transmission method is a serial transmission method. Each of the image signals and the display controlling signals is converted into packetized wireless signals by the serial transmission method, so that the reception of the wireless signals is intermittently executed, for example, between the external such as the body of the mobile phone, etc. and the converter. By intermittently executing the reception of the image data, the reduction of the power consumption of the electro-optical device can be realized.

According to another aspect of the invention, an electronic apparatus comprises: a display unit having the electro-optical device mounted thereon; a body portion, wherein the display unit and the body portion are detachably mounted to each other by a supporting apparatus mounted to at least any one side of the display unit and the body portion and wherein the body portion comprises other converter that has other antenna transmitting the wireless signals including the image signals and the display controlling signals between the body portion and the converter in the electro-optical device, based on the wireless transmission method and that has a function to convert other wire signals output from predetermined circuits into the wireless signals; a controlling circuit that generates the image signals and the display controlling signals and outputs the image signals and the display control signals to the other converter; and other power source portion that supplies power to the other converter and the controlling circuit.

As the electronic apparatus, for example, a mobile phone, a personal digital assistant, a personal computer, a liquid crystal TV, a viewfinder type and a monitor direct viewing type video tape recorder, a car navigation device, a pager, an electronic notebook, a calculator, a word processor, a workstation, a video phone, a POS terminal, a digital still camera, etc. may be included.

The electronic apparatus is constituted by the including display unit having the electro-optical device mounted thereon and the body portion. Accordingly, it can display images on the display unit by this configuration. The display unit and the body portion are detachably mounted to each other by the supporting apparatus mounted to at least any one side of the display unit and the body portion. Accordingly, if necessary, the display can be detached from the body portion.

Also, the body portion comprises the other converter that has the other antenna transmitting the wireless signals including the image signals and the display controlling signals between the body portion and the converter in the electro-optical device, based on the wireless transmission method; and that has a function to convert the other wire signals output from the predetermined circuits such as the controlling circuit as will be described below (for example, a base band engine), etc. into the wireless signals. That is, the body portion can execute a wireless communication rather that a wire communication between the converter in the electro-optical device and the other converter in the body portion.

Further, the body portion has the controlling circuit such as the base band engine, etc. including for example, various memories, an arithmetic processing unit, a register, etc. that generates the image signals and the display controlling signals and outputs the image signals and the display controlling signals to the other converter. That is, the controlling circuit can output in particular the image signals and the display controlling signals generated to the other converter.

In addition, the body portion has other power source portion that supplies power to the other converter and the controlling circuit. As an appropriate example, it is preferable that the other power source portion has a power source that can readily be charged by a contact-less type charging method according to the known electromagnetic induction; and a power supply circuit that supplies power obtainable from the other power source to the other converter and the controlling circuit. Thereby, the other power source portion can supply power to the other converter and the controlling circuit.

In case of the electronic apparatus according to the aspects as described above, the communication portion (hereinafter, referred to as an interface portion) between the display unit and the body portion is provided with the converter having the antenna of the electro-optical device mounted on the display unit and the other converter having the other antenna of the body portion, respectively. The interface portion is constituted by a wireless rather than a wire.

Thereby, the interface portion in the electronic apparatus can be implemented as a simple structure. That is, it is unnecessary to install the plurality of wirings or the filter for removing noises in the interface portion. Therefore, the degree of freedom of the design of the peripheral of the supporting apparatus, that is, the degree of freedom of the design of the interface portion can be improved as well as the degree of freedom of the design of the electro-optical device and the electronic apparatus can be improved. Consequently, the miniaturization and lightweight of the electro-optical device and the electronic apparatus can be realized.

Also, the converter can execute a two-way communication between the external and the predetermined circuits so that the reliability (for example, existence or non-existence of errors) of data upon transceiving the data is investigated by the two-way communication to correct the errors, etc., thereby improving the reliability of communication.

As an appropriate example, it is preferable that the other converter has a function to receive the other wireless signals transmitted from the other converter in the display unit via the other antenna and to convert them into the wire signals and a function to output the wire signals to the controlling circuit. Therefore, the other converter can execute a two-way communication with the converter in the display unit. Accordingly, the reliability (for example, existence or non-existence of errors) of data upon transceiving the data is investigated by the two-way communication to correct the errors, etc., thereby improving the reliability of communication.

Further, as a very appropriate example, in this wireless transmission method, it is preferable that the transmission and/or the reception of wireless signals is executed between the converter having the antenna and the other converter having the other antenna by using frequency hands not to be overlapped with a frequency band for a communication of the electronic apparatus and a frequency band for a transmission and reception of a mail. Thereby, it is difficult that various unnecessary noises generated in the electronic apparatus enter the wireless signals such as the image data, etc. Also, in the case that the electronic apparatus is the mobile phone, when the communication or the transmission and reception of the mail is executed using the mobile phone while executing the transmission and/or the reception of the image data, etc. between the other converter in the body portion and the converter in the display unit, it can prevent unnecessary noises generated upon making the communication and the transmission and reception of the mail from entering the image data. Therefore, the interference problems due to the noises involved in the transmission of the signals such as the image data, etc. can be solved. Further, the wireless transmission method may be a serial transmission method. It is preferable that each of the image signals and the display controlling signals is converted into the packetized wireless signals by the serial transmission method, so that the transmission and/or the reception of the wireless signals is intermittently executed between the other converter in the body portion and the converter in the display unit. By intermittently executing the transmission and/or the reception of the image data, etc., the reduction of the power consumption of the electronic apparatus can be realized.

Moreover, in the electronic apparatus, the body portion is provided with other power source portion and the display unit is provided with a separate power source portion independently of the other power source portion. Thereby, compared with a comparison example that supplies power to the display unit and the body portion by installing one power source portion in any one side of the display unit and the body portion, the lifetime of the power source portion and the other power source portion can be improved about twice so that the reduction of power consumption can be realized. Thereby, it is preferable that only the image signals and the display controlling signals are transmitted from the controlling circuit in the body portion to the display unit so that high speed wireless communication can be realized.

Further, since the display unit and the body portion are detachably mounted by the supporting apparatus as described above, the display unit can be detached from the body portion, if necessary.

Accordingly, if they can be realized, the variation of the usage of the electronic apparatus can be widen as follows, for example: a user carries only the display unit in order to allow the user to view display images such as call states of a mail and a phone, etc. at any time while putting the body portion in the user's pocket except when the user operates the body portion (for example, in the case that the electronic apparatus is the mobile phone, when the user operates operating keys provided on the body portion); a user operates the body portion and then uses only the display unit to transmit predetermined radios to a key system of the front door so that the user can electronically open and shut the key of the front door; or a user operates the body portion and then approaches only the display unit to the electronic payment system mounted on an automatic vending machine or a counter, etc. to transmit predetermined radios to the electronic payment system so that the user can make an electronic payment (electronic money function), etc.

Further, according to a still further aspect of the invention, an electronic apparatus comprises: a display unit having the electro-optical device mounted thereon; a body portion, wherein the display unit and the body portion are detachably mounted to each other by a supporting apparatus mounted to at least any one side of the display unit and the body portion and wherein the electro-optical device comprises the display portion that displays the images; a power source portion; a converter that has an antenna receiving wireless signals including display controlling signals and image signals from the external, based on a wireless transmission method and that converts the wireless signals received from the antenna into wire signals; a driving circuit that is electrically connected to the power source portion and the converter, respectively, to display the images on the display portion based on the power supplied from the power source portion and the image signals and the display controlling signals output from the converter; and wherein the body portion comprises other converter that has other antenna transmitting the wireless signals including the image signals and the display controlling signals between the body portion and the converter in the electro-optical device based on the wireless transmission method and that has a function to convert other wire signals output from predetermined circuits into the wireless signals; a controlling circuit that generates the image signals and the display controlling signals and outputs the image signals and the display control signals to the other converter; and other power source portion that supplies power to the other converter and the controlling circuit.

As the electronic apparatus, for example, a mobile phone, a personal digital assistant, a personal computer, a liquid crystal TV, a viewfinder type and a monitor direct viewing type video tape recorder, a car navigation device, a pager, an electronic notebook, a calculator, a word processor, a workstation, a video phone, a POS terminal, a digital still camera, etc. may be included.

The electronic apparatus is constituted by including the display unit having the electro-optical device mounted thereon and the body portion.

The display unit and the body portion are detachably mounted to each other by the supporting apparatus mounted to at least any one side of the display unit and the body portion. Accordingly, if necessary, the display can be detached from the body portion.

Herein, the electro-optical device comprises: a display portion that displays images such as characters or figures, etc.; a power source portion; a converter that has an antenna receiving wireless signals including image signals corresponding to image data to be displayed from the external such as a controlling circuit (for example, a base band engine) in the electronic apparatus and display controlling signals such as horizontal synchronizing signals, vertical synchronizing signals, or dot clock signals, etc., based on the wireless transmission method and that converts wireless signals received from the antenna into wire signals; and a driving circuit such as, for example, a driver IC, etc. that is electrically connected to the power source portion and the converter, respectively, to display the images on the display portion based on the power supplied from the power source portion and the image signals and the display controlling signals as the wire signals output from the converter. Thereby, it is possible to display the images on the display unit. As an appropriate example, it is preferable that the power source portion comprises: a power source that can readily be charged by a contact-less type charging method according to the known electromagnetic induction; and a power supply circuit that supplies power obtainable from the power source to the converter and the driving circuit.

Also, the body portion comprises the other converter that has the other antenna transceiving the wireless signals including the image signals and the display controlling signals between the body portion and the converter in the electro-optical device, based on the wireless transmission method; and that has a function to convert the other wire signals output from the predetermined circuits such as the controlling circuit as will be described below (for example, a base band engine), etc. into the wireless signals. That is, the body portion can execute a wireless communication rather that a wire communication between the converter in the electro-optical device and the other converter in the body portion.

Further, the body portion has the controlling circuit such as the base band engine, etc. including for example, various memories, an arithmetic processing unit, a register, etc. that generates the image signals and the display controlling signals and outputs the image signals and the display controlling signals to the other converter. That is, the controlling circuit can output in particular the image signals and the display controlling signals generated to the other converter.

In addition, the body portion has the other power source portion that supplies power to the other converter and the controlling circuit. As an appropriate example, it is preferable that the other power source portion has a power source that can readily be charged by a contact-less type charging method according to the known electromagnetic induction; and a power supply circuit that supplies power obtainable from the other power source to the other converter and the controlling circuit. Thereby, the other power source portion can supply power to the other converter and the controlling circuit.

In case of the electronic apparatus according to the aspects as described above, the communication portion (hereinafter, referred to as an interface portion) between the display unit and the body portion is provided with the converter having the antenna of the electro-optical device mounted on the display unit and the other converter having the other antenna of the body portion, respectively. The interface portion is constituted by a wireless rather than a wire.

Thereby, the interface portion in the electronic apparatus can be implemented as a simple structure. That is, it is unnecessary to install the plurality of wirings or the filter for removing noises in the interface portion. Therefore, the degree of freedom of the design of the peripheral of the supporting apparatus, that is, the degree of freedom of the design of the interface portion can be improved as well as the degree of freedom of the design of the electro-optical device and the electronic apparatus can be improved. Consequently, the miniaturization and lightweight of the electro-optical device and the electronic apparatus can be realized.

Further, as a appropriate example, in this wireless transmission method, it is preferable that the transmission and/or the reception of wireless signals is executed between the converter having the antenna and the other converter having the other antenna by using frequency bands not to be overlapped with a frequency band for a communication of the electronic apparatus and a frequency band for a transmission and reception of a mail. Thereby, it is difficult that various unnecessary noises generated in the electronic apparatus enter the wireless signals such as the image data, etc. Also, in the case that the electronic apparatus is the mobile phone, when the communication or the transmission and reception of the mail is executed using the mobile phone while executing the transmission and/or the reception of the image data, etc. between the other converter in the body portion and the converter in the display unit, it can prevent unnecessary noises generated upon making the communication and the transmission and reception of the mail from entering the image data. Therefore, the interference problems due to the noises involved in the transmission of the signals such as the image data, etc. can be solved. Further, the wireless transmission method may be a serial transmission method. It is preferable that each of the image signals and the display controlling signals is converted into the packetized wireless signals by the serial transmission method, so that the transmission and/or the reception of the wireless signals is intermittently executed between the other converter in the body portion and the converter in the display unit. By intermittently executing the transmission and/or the reception of the image data, etc., the reduction of the power consumption of the electronic apparatus can be realized.

Moreover, in the electronic apparatus, the body portion is provided with other power source portion and the display unit is provided with a separate power source portion independently of the other power source portion. Thereby, compared with a comparison example that supplies power to the display unit and the body portion by installing one power source portion in any one side of the display unit and the body portion, the lifetime of the power source portion and the other power source portion can be improved about twice so that the reduction of power consumption can be realized. Thereby, it is preferable that only the image signals and the display controlling signals are transmitted from the controlling circuit in the body portion to the display unit so that high speed wireless communication can be realized.

As an appropriate example, there is a wiring board such as, for example, a flexible print board (FPC), etc. electrically, connected to the driving circuit provided on the electro-optical device, wherein the converter can be provided on the wiring board. Also, as a very appropriate example, it is preferable that the converter is included, as a circuit, in the driving circuit and the antenna is drawn out from the converter to outside of the driving circuit. It is preferable that the driving circuit is provided on the board and the converter is included, as a circuit, in the driving circuit and the antenna is drawn out from the converter of the substrate or to a position near the driving circuit. Accordingly, since it is unnecessary to install the wiring board by the configuration as above, the degree of freedom of the design of the electronic apparatus including the interface portion is further improved so that the miniaturization and lightweight of the electronic apparatus can be realized.

Also, as an appropriate example, the electro-optical device comprises a plurality of first wires such as, for example, the data lines, etc. that are electrically connected to the driving circuit to output data signals from the driving circuit; a plurality of second wires such as, for example, the scan lines, etc. that are electrically connected to the driving circuit and extended and arranged in a direction to be intersected with the plurality of first wires to output scan signals from the driving circuit; and a plurality of pixel electrodes that are provided to correspond to the intersecting positions of the plurality of first wires and the plurality of second wires and electrically connected to the plurality of first wires, wherein the display portion corresponds to a region in which the plurality of unit pixel electrodes are provided.

According to an aspect of the electronic apparatus, the converter has a function to convert the wire signals output from the predetermined circuits into the wireless signals and a function to transmit the wireless signals to the external including the other converter via the antenna, the other converter has function to receive the wireless signals transmitted from the converter in the display unit via the other antenna and to convert them into the wire signals and a function to output the wire signals to the controlling circuit. Thereby, it is possible to execute a two-way communication between the other converter, etc. in the body portion and the converter in the display unit. Accordingly, since the reliability (for example, existence or non-existence of errors) of data upon transceiving the data is investigated by the two-way communication to correct the error, etc., the reliability of communication can be improved.

Accordingly, if they can be realized, the variation of the usage of the electronic apparatus can be widen as follows, for example: a user carries only the display unit in order to allow the user to view display images such as call states of a mail and a phone, etc. at any time while putting the body portion in the user's pocket except when the user operates the body portion (for example, in the case that the electronic apparatus is the mobile phone, when the user operates operating keys provided on the body portion); a user operates the body portion and then uses only the display unit to transmit predetermined radios to a key system of the front door so that the user can electronically open and shut the key of the front door; or a user operates the body portion and then approaches only the display unit to the electronic payment system mounted on an automatic vending machine or a counter, etc. to transmit predetermined radios to the electronic payment system so that the user can make an electronic payment (electronic money function), etc.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the drawings. In each embodiment described below, the invention is applied to a mobile phone as one example of an electronic apparatus or a liquid crystal device as one example of an electro-optical device mounted on a mobile phone.

Configuration of Mobile Phone

Figure 1B:
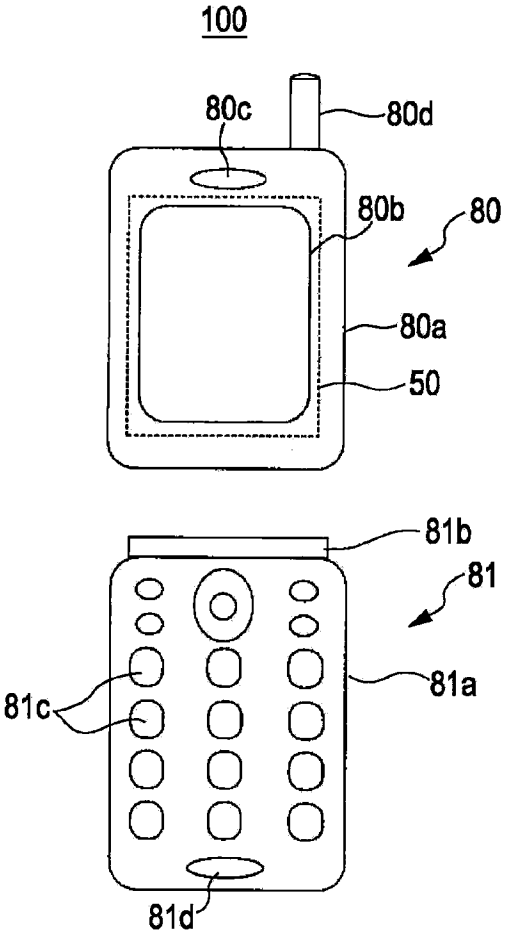
FIGS. 1A and 1B show various front diagrams of a configuration of a mobile phone according to an embodiment of the invention.

A configuration of a mobile phone having a liquid crystal device mounted thereon according to an embodiment of the invention will first be described with reference to FIG. 1 and FIG. 2.

Figure 1A:
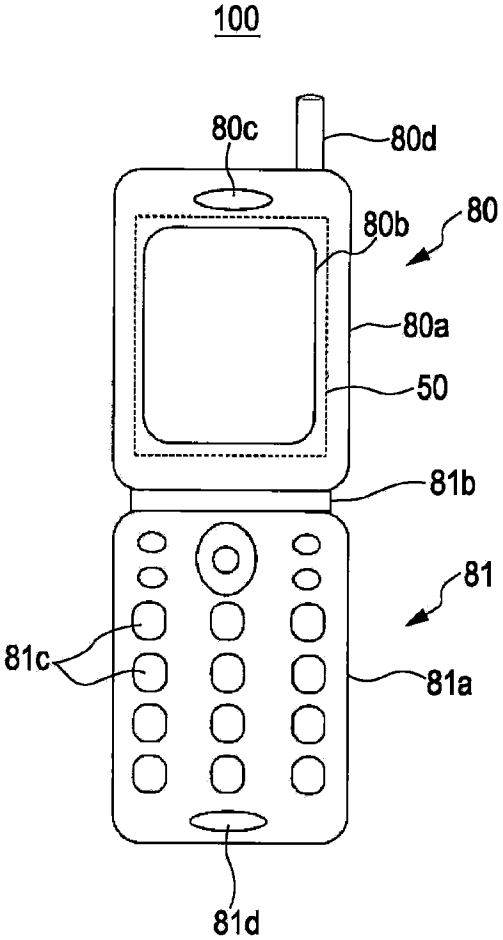
Figures 2A, 2B:
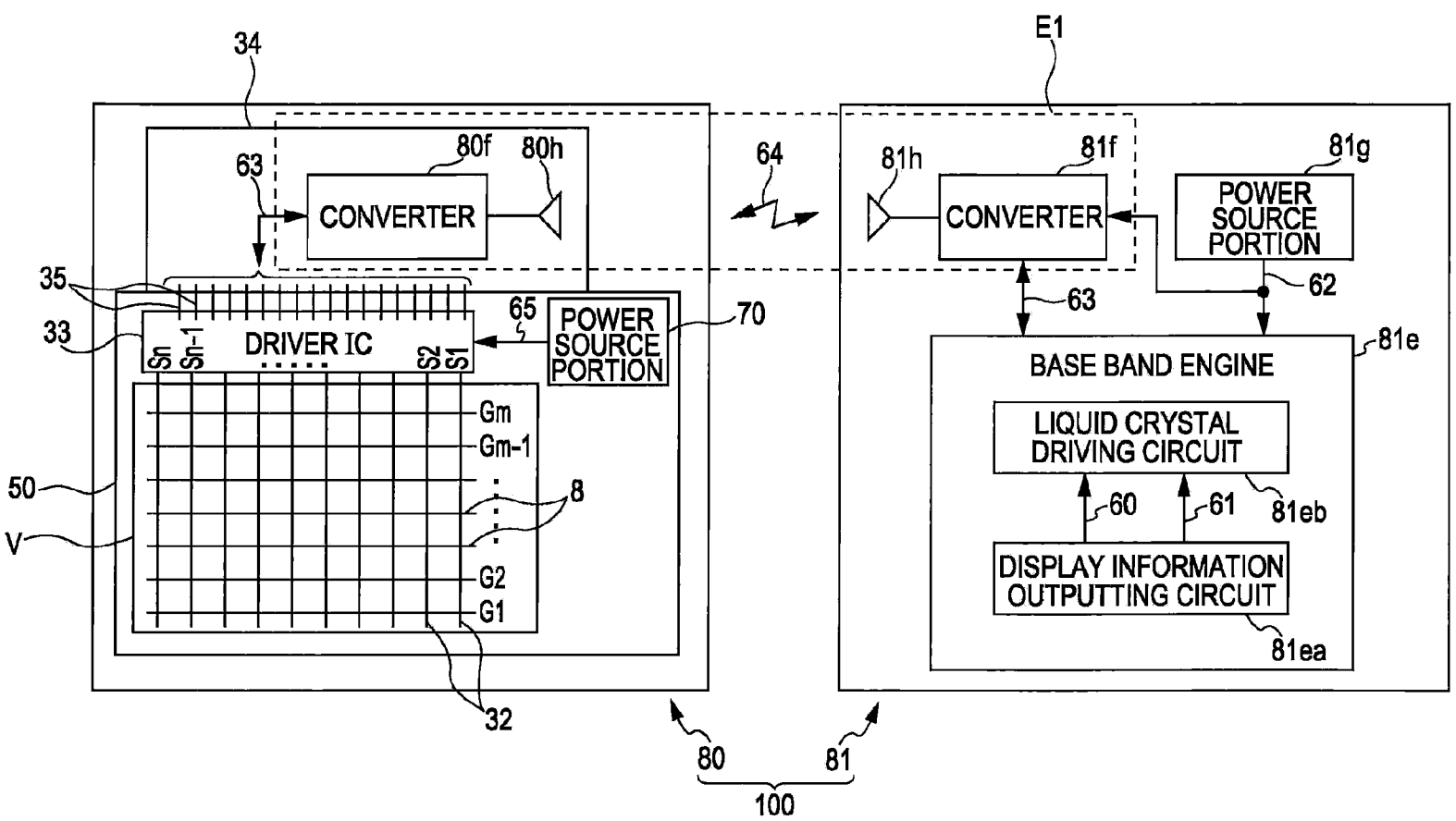
FIG. 2 shows a block diagram of a circuit configuration of a mobile phone according to an embodiment of the invention.

FIG. 1A shows a front view of a mobile phone 100 having a liquid crystal device 50 according to the invention mounted thereon.

The mobile phone 100 is constituted by including a display unit 80 and a body portion S1. The display unit 80 is detachably mounted on a supporting apparatus 81*b*, which is mounted to the body portion 81. That is, the supporting apparatus 81*b* detachably connects the display unit 80 and the body portion 81 to each other. FIG. 1(*b*) shows a state in which the display unit 80 is detached from the body portion 81. Also, the supporting apparatus 81*b* rotates both the display unit 80 and the body portion 81 in a state that the display unit 80 is connected to the body portion 81. Accordingly, it is possible to fold the display unit 80 into the body portion 81 or open the display unit 80 from the body portion 81 by relatively rotating the display unit 80 and the body 81 using the supporting apparatus 81*b* as a rotating axis.

The display unit 80 comprises a housing 80*a* housing a liquid crystal device 50, etc.; a display portion 80*b* that is a region arranged with an effective displaying region (see FIG. 2 and FIG. 3) of the liquid crystal device 50 and displaying characters or images; a receiver 80*c* outputting speech received from a person upon communication; and an antenna 80*d* that transmits and receives wireless signals to and from a base station, etc. Meanwhile, the body portion 81 comprises a housing 81*a* housing various circuit substrates, etc.; a supporting apparatus 81*b* provided on one side of the housing 81*a* and having the functions; a plurality of operating keys 81*c* that executes various operations such as the origination of a telephone number or the transmission and reception of a mail, etc.; and a transmitter that detects a voice transmitted to a person upon communicating.

Next, a circuit configuration of the mobile phone according to the invention will be described with reference to FIG. 2. FIG. 2 schematically shows a block diagram of a circuit configuration of the mobile phone 100 according to the invention.

The display unit 80 receives the liquid crystal device 50 according to the embodiment of the invention in the state of arranging the effective displaying region V on the display portion 80*b*. Although the detailed configuration of the liquid crystal device 50 is described below, the liquid crystal device 50 has an effective displaying region V; data lines 32 to which display data are supplied; scan lines 8 to which scan signals are supplied; a driver IC 33 that supplies the data signals and the scan signals, respectively, to their wirings (see FIG. 3). The driver IC 33 is connected to a flexible print board 34 (Hereinafter, referred to as FPC 34) by interposing a plurality of external connecting wirings 35. Also, the driver IC 33 receives power 65 from the power source portion 70. Herein, it is preferable that the power source portion 70 comprises a power source (not shown) that can readily be charged by a contact-less type charging method according to the known electromagnetic induction; and a power supply circuit (not shown) that supplies the power 65 obtainable from the power source to the driver IC 33 and a converter 80*f* (a transceiver) having a transceiving antenna 80*h* described below via the driver IC 33. The FPC 34 is provided with the converter 80*f* having a transceiving antenna 80*h* that executes the transmission and reception of wireless signals 64 to and from the body portion 81. Meanwhile, the body portion 81 comprises a base band engine (BBE) 81*e* as a controlling circuit including a memory, an arithmetic processing unit, and a register and controlling various functions in the mobile phone 100; a converter (a transceiver) 81*f* having a transceiving antenna 81*h* that executes the transmission and reception of the wireless signals 64 to and from the display unit 80; and a power source portion 8*g*. The base band engine 81*e* comprises a display information outputting circuit 81*ea* and a liquid crystal driving circuit 81*eb*, etc. It is preferable that the power source portion 81*g* comprises a power source (not shown) that can readily be charged by a contact-less type charging method according to the known electromagnetic induction; and a power supply circuit (not shown) that supplies power 62 obtainable from the power source to the converter 81*f* and the base band engine 81*e*, respectively.

Next, a driving method of the mobile phone 100 having the configuration described above will be described.

First, the display information outputting circuit 81*ea* outputs display data signals (image signal) 60 and display controlling signals 61 to the liquid crystal driving circuit 81*eb* based on operating instructions from the operating keys 81*c* by a user. Herein, the display data signals 60 are data corresponding to image data to be displayed and the display controlling signals 61 correspond to various controlling signal such as horizontal synchronizing signals, vertical synchronizing signals or dot clock signals, etc. Meanwhile, the liquid crystal driving circuit 81*eb* obtains the display data signals 60 and the display controlling signals 61, respectively, from the display information outputting circuit 81*ea* to output various signals 63 such as data signals, clock signals, and vertical synchronizing signals, etc. to the converter 81*f*.

Next, the converter 81*f* obtains the various signals 63 from the liquid crystal driving circuit 81*eb* to convert the various signals 63 as wire signals into the wireless signals 64 and then transmit the wireless signals 64 to the transceiving antenna 80*h* in the display unit 80 via the transceiving antenna 81*h*.

Herein, the wireless transmission method can adopt known various methods. However, the transmission and reception of the wireless signals 64 is executed using frequency bands not to be overlapped with frequency bands for the communication of the mobile phone 100 and the transmission and reception of the mail between the converter 80*f* in the display unit 80 and the converter 81*f* in the body portion, based on the wireless transmission method.

Next, the converter 80*f* receives the wireless signals 64 via the transceiving antenna 80*h* to convert (decode) the wireless signals 64 into the various signals (wire signals) 63 such as the data signal, the clock signal, and the vertical synchronizing signals, etc. and output the various signals 64 to the driver IC 33 by interposing the plurality of external connecting wirings 35. Meanwhile, the driver IC 33 supplies the image signals to n data lines S1 to Sn based on the clock signals included in the various signals 63 and sequentially scans scan lines G1 to Gm based on the clock signals and the vertical synchronizing signals included in the various signals 64. By executing this, desired characters or images are displayed on the effective displaying region V, that is, the display portion 80*b* of FIGS. 1A and 1B.

Also, in the example, the converter 80*f* in the display unit 80 has a function to convert the wire signals output from the driver IC 33 into the wireless signals to transmit the wireless signals to the converter 81*f* in the body portion 81 or the external via the transceiving antenna 80*h*. Further, the converter 81*f* in the body portion 81*f* has a function to convert the predetermined wireless signals transmitted from the converter 80*f* in the display unit 80 or the external into the predetermined wire signals to output the wireless signals to the base band engine 81*e* via the transceiving antenna 81*h*. In addition, the baseband engine 81*e* can obtain the wire signals. Also, according to an aspect of the invention, the configuration as described above is not limited. For example, it is possible to replace the transceiving antenna 80*h* with a receiving antenna and the transceiving antenna 81*h* with a transmitting antenna, in the configuration described above. Therefore, it may be allowed the configuration that the converter 81*f* in the body portion 81 has a function to convert the wireless signals output from the baseband engine 81*e* into the wireless signals to transmit the wireless signals to the converter 80*f*, and the converter 80*f* in the display unit 80 has only function to convert the wireless signals transmitted from the converter 81f into the wireless signals to the driver IC 33 by interposing the plurality of external connecting wirings 35. Also, the mobile phone 100 has various functions such as a camera pickup function or a mail transceiving function, etc., however, the description thereof will be omitted.

Configuration of Liquid Crystal Device

Next, a configuration of a liquid crystal device 50 used in the mobile phone 100 will be described. Also, one displaying region existing in one sub-pixel region SG may be referred to as "sub-pixel" and a displaying region corresponding to one pixel region AG may also be referred to as "one pixel".

Figure 3:
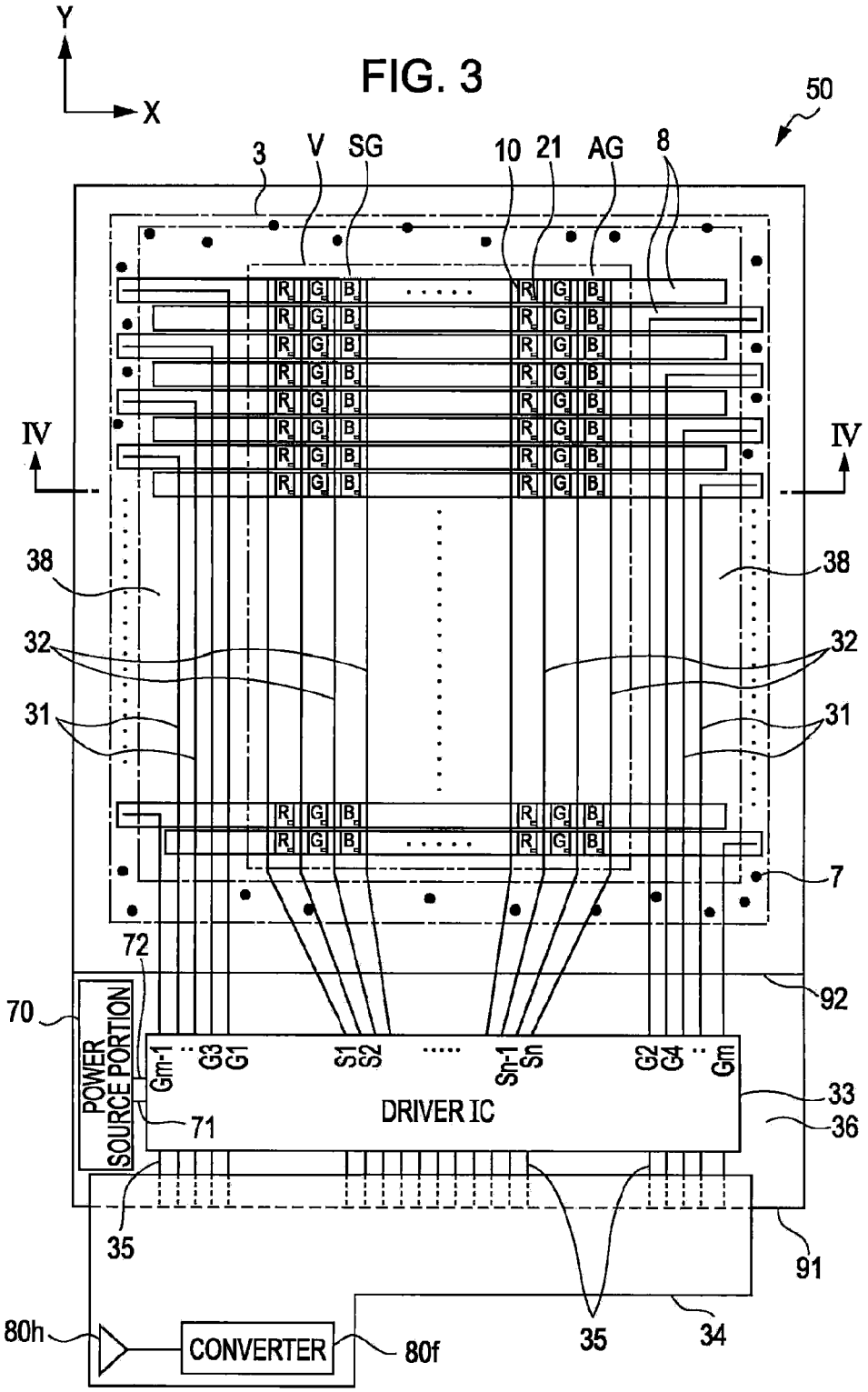
FIG. 3 diagrammatically shows a plan diagram of a liquid crystal device according to an embodiment of the invention.
Figure 4:
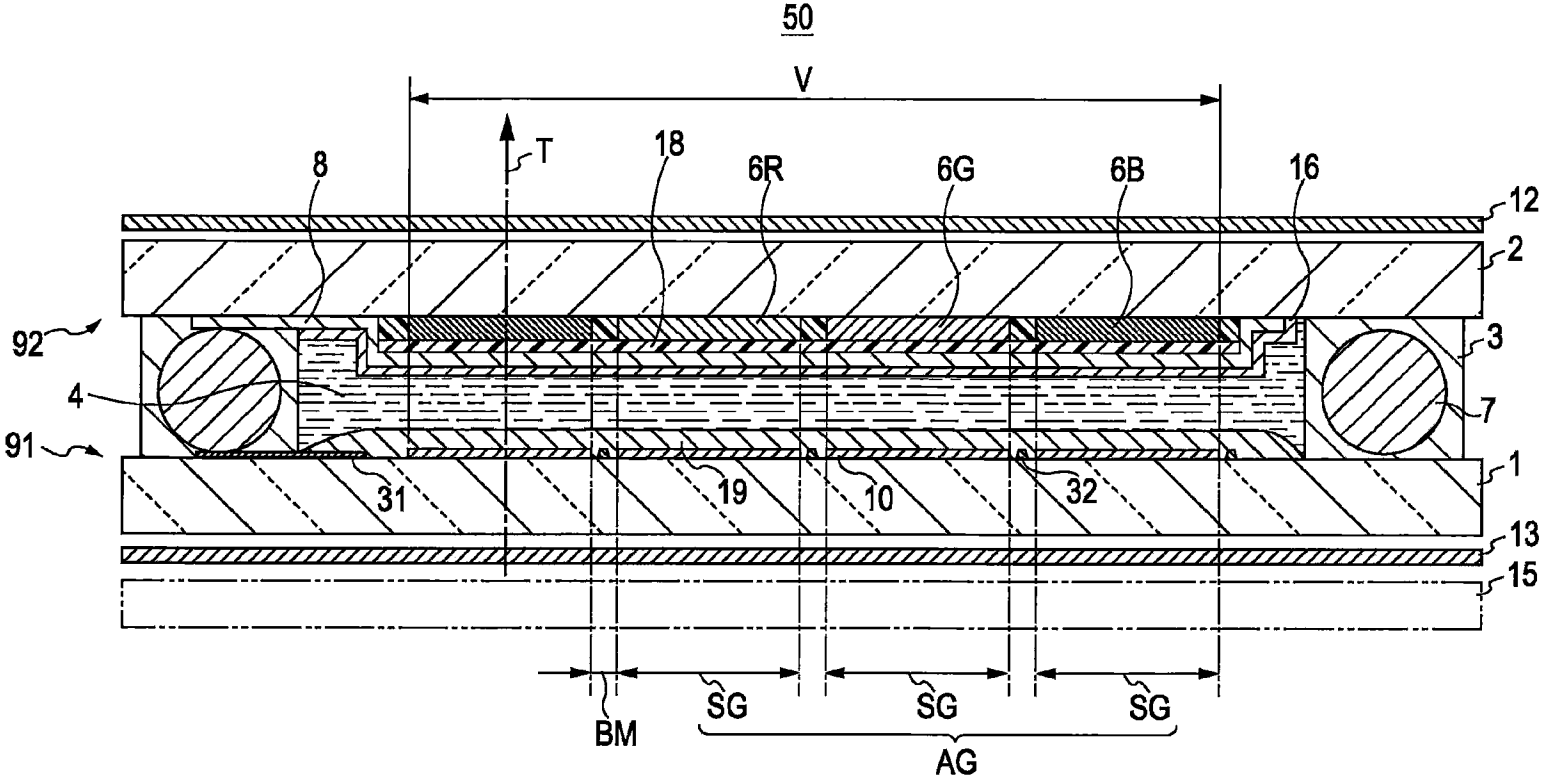
FIG. 4 shows a cross-sectional diagram of a liquid crystal device taken along Line A-A'.

FIG. 3 diagrammatically shows a plan diagram of a schematic configuration of the liquid crystal device 50 according to an embodiment of the invention. In FIG. 3 defines the up direction on paper as Y direction, and the right direction on paper as X direction, respectively, for convenience of explanation. Herein, the liquid crystal device 50 according to the embodiment of the invention is a transmission type liquid crystal device that depends on an active matrix driving method using a thin film diode (TFD) element. FIG. 4 shows a cross-sectional diagram of the liquid crystal device 50 taken along A-A' line and in particular, is a cross-sectional diagram of the liquid crystal device 50 taken at a position passing through a sub-pixel group forming one column in one X direction.

The cross-sectional configuration of the liquid crystal device 50 will first be described with reference to FIG. 4.

The liquid crystal device 50 is constituted by forming a liquid crystal layer 4 by cladding an element substrate 91 and a color filter substrate 92 disposed to be opposite thereto through the interposition of a mold shape of a seal material 3 therebetween and by sandwiching liquid crystal in regions divided by the mold shape of the seal material 3. The seal material 3 in the mold shape is incorporated with a conducting member 7 such as a plurality of metal particles, etc.

On an inner face of a lower substrate 1 having insulation characteristic the pixel electrodes 10 made of transparent conductive material such as indium tin oxide (ITO), etc. every the sub-pixel region SG are formed. The data lines 32 are formed between the pixel electrodes adjacent to each other on the inner face of the lower substrate 1, which are made of chrome, etc. On the inner faces of the pixel electrodes 10 and the data lines 32 an alignment film 19 made of organic materials such as polyimide resin, etc. is formed.

Meanwhile, on an inner face of an upper substrate 2 having insulation characteristic colored layers 6R, 6G and 6B formed of any one of three colors of red (R), green (G), and blue (B) every the sub-pixel region SG are formed. The color filet is constituted by the colored layers 6R, 6G and 6B. One pixel region AG indicates a region by one pixel of color configured of the sub-pixel of R, G and B. Also, a case indicating a colored layer independently of colors is referred to as only "colored layer 6" and a case indicating a colored layer by discriminating colors is referred to as "colored layer 6R", etc., as will be described below. A position, etc dividing the respective sub-pixel regions SG on the inner face of the upper substrate 2 a black matrix (hereinafter, referred to as "BM") having light shielding characteristics that separates the adjacent sub-pixels from each other and prevents incorporation of light from one sub-pixel to other sub-pixel is formed.

On the colored layer 6 and the inner face of the BM an overcoat layer 18 made of acrylic resin, etc. is formed. This overcoat layer 18 has a function to protect the colored layer 6, etc. from being corroded or polluted due to chemicals, etc. used during a manufacturing process. On the inner face of the overcoat layer 18 the scan lines 8 having the rectangular shape and made of transparent conductive materials such as ITO, etc. are formed. On the inner face of the scan lines 8 the alignment film 16 made of organic materials such polyimide resin, etc. is formed.

Further, the one end of the scan line 8 is positioned in the seal material 3 so that it is electrically connected to the conducting member 7 in the seal material 3. Left and right peripheral portions on the inner face of the lower substrate 1 is formed with a wiring 31 made of chrome, etc. The one end of the wiring 31 is positioned in the seal material 3 so that it is electrically connected to the conducting member 7 incorporated in the seal material 3. The wirings 31 of the lower substrate 1 and the scan lines 8 of the upper substrate 2 are conducted up and down by interposing the conducting member 7 incorporated in the seal material 3 therebetween.

Further, on the outer face of the lower substrate 1, a polarizing plate 13 is disposed and on the outer face of the upper substrate 2 a polarizing plate 12 is disposed. On the outer face of the polarizing plate 13 a backlight 15 as an illuminating apparatus is disposed. As the backlight 15, for example, a point light source such as a light emitting diode, etc., a line light source such as a cold cathode fluorescent lamp, etc., or a combination of them and a light pipe is very useful.

In the liquid crystal device 50 having the configuration as above, in case of making a transmission type display, the illuminating light emitted form the backlight 15 is propagated along a path T shown in FIG. 4 and then passes through the colored layer 6 and the pixel electrodes 10 so that it reaches a viewer. In this case, the illuminating light transmits the colored layer 6 so that a predetermined color and brightness are displayed. Thereby, a viewer can view desired color display images.

Circuit Configuration

Figure 5:
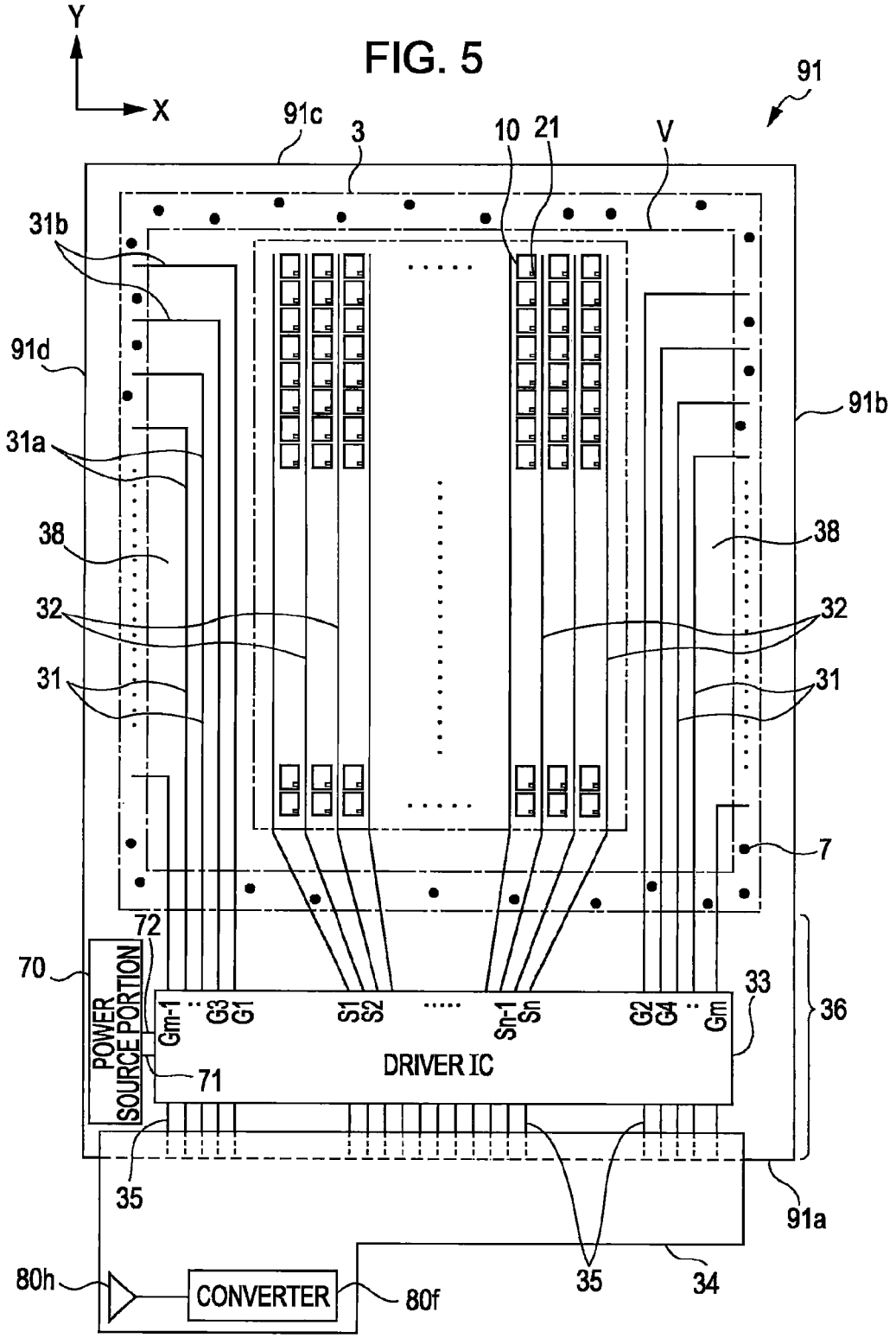
FIG. 5 diagrammatically shows a plan diagram of a circuit configuration of an element substrate according to an embodiment of the invention.
Figure 6:
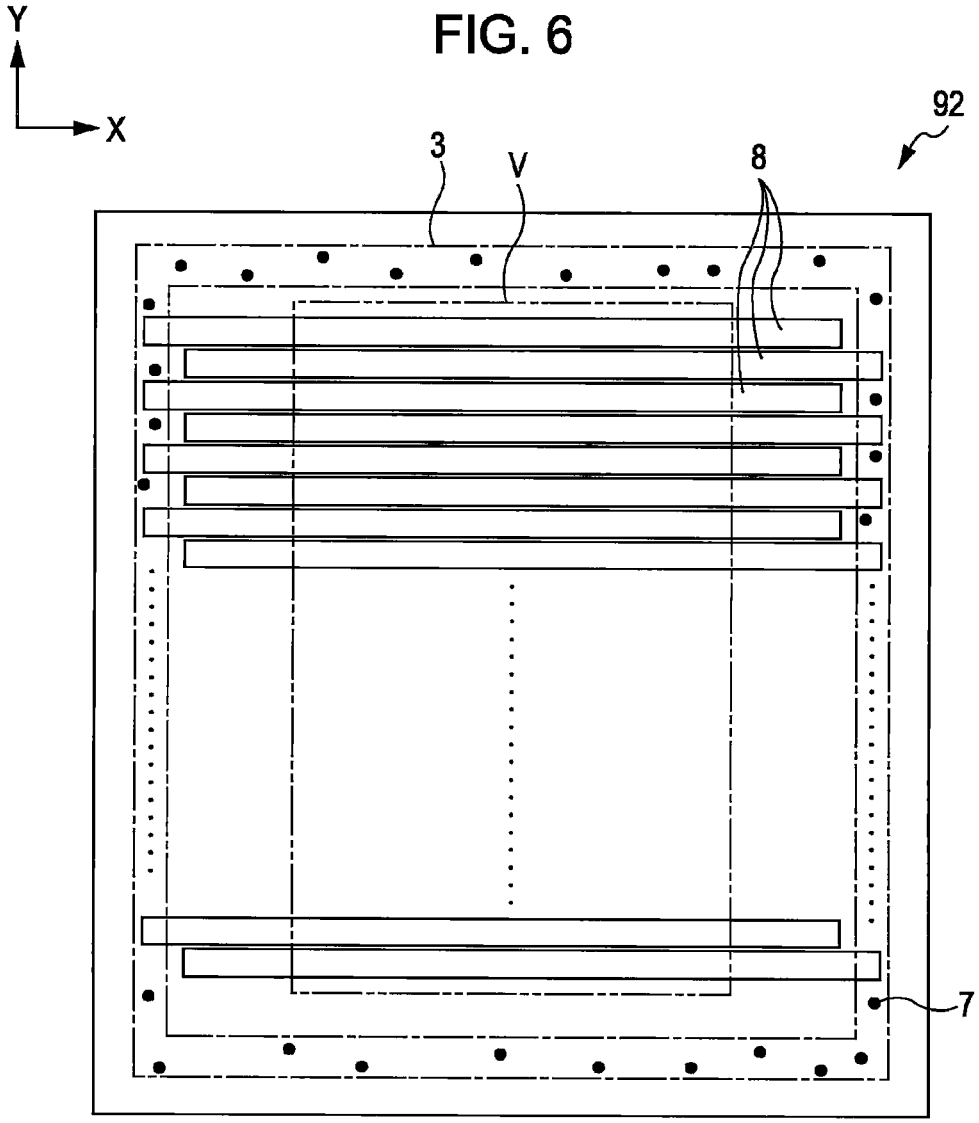
FIG. 6 diagrammatically shows a plan diagram of a circuit configuration of a color filter substrate according to an embodiment of the invention.

The circuit configuration having the electrodes and the wirings of the element substrate 91 and the color filter substrate 92 will now be described with reference to FIG. 3, FIG. 5, and FIG. 6. FIG. 5 shows as a plan diagram the circuit configuration of the element substrate 91 when viewing the element substrate 91 from a front direction (that is, from the top in FIG. 4). FIG. 6 shows as a plan diagram the circuit configuration of the color filter substrate 92 when viewing the color filter substrate 92 from a front direction (that is, from the bottom in FIG. 4). Also, the elements other than the electrodes and the wirings are omitted in the FIG. 5 and FIG. 6 for convenience of explanation.

In FIG. 3, intersecting regions of the pixel electrodes 10 of the element substrate 91 and the scan lines of the color filter constitutes one sub-pixel region SG, which is a minimum unit of a display. The sub-pixel region SG exists plural numbers in a vertical direction on paper and a horizontal direction on paper and a region arranged in parallel in a matrix shape is an effective displaying region V (a region enclosed with a two-dot chain line). On the effective display region V images such characters, numbers, and figures, etc. are displayed. Also, the region divided by the outer peripheral of the liquid crystal device 50 and the effective displaying region V becomes a picture frame region not contributing to the image display.

The configuration of the circuit having the electrodes and the wirings of the element substrate 91 is as follows.

As shown in FIG. 5, the element substrate 91 comprises a TFD element 21, pixel electrodes 10, a plurality of data lines 32, a driver IC 33, a power source portion 70, and a plurality of external connecting terminals 35.

The element substrate 91 has an extended region formed by being extended from the one end of the color filter substrate 92 to the outside thereof. On the extended region the driver IC 33 is mounted by interposing an anisotropic conductive film (ACF) therebetween. Also, in FIG. 5, a direction from the one side 91*a* the region 36 extended from the element substrate 91 toward the side 91*c* opposite thereto is referred to as Y direction and a direction from the side 91*d* toward the side 91*b* opposite thereto is referred to as X direction.

On the extended region the plurality of external connecting terminals 35 are formed. The respective input terminals (not shown) of the driver IC 33 are connected to the plurality of external connecting terminals 35, respectively, by interposing a bump having conductive characteristics therebetween. The external connecting terminals 35 are connected to the FPC 34 by interposing the ACF or a solder therebetween. The FPC 34 is provided with the converter 80*f* including the transceiving antenna 80*h* for transceiving the wireless signals 64.

The respective output terminals (not shown) of the driver IC 33 are connected to the plurality of data lines 32 and the plurality of wirings 31, respectively, by interposing the bump having conductive characteristics therebetween. The external connecting terminals 35 are connected to the FPC 34 by interposing the ACF or a solder therebetween. The FPC 34 is provided with the converter 80*f* including the transceiving antenna 80*h* for transceiving the wireless signals 64. In accordance with this, the driver IC 33 can supply the data signals to the data lines 32 and the scan signals to the scan lines 8.

It is preferable that the power source portion 70 has the power and the power supplying circuit as described above, and also potential supplying wirings 71 and ground wirings 72. The power source portion 70 is provided in the region not to be overlapped with the effective displaying region V. In the embodiment, the power source portion is provided on the extended region 36 and a position near the driver IC 33. Also, according to the invention, a setting position of the power source portion 70 for the liquid crystal device 50 is not limited. For example, in case of the liquid crystal device having a reflective type display mode, it is possible to dispose the power source portion 70 on a position to be overlapped with the effective display region V of the color filter substrate 92. Also, in case of the liquid crystal device other than that as described above, it may be preferable that a thin power source portion 70 (for example, battery, etc.) is disposed on a position to be overlapped with the whole effective display region V. The potential supplying wirings 71 and the ground wirings 72 each is electrically connected to the driver IC. In accordance with this, the power source portion 70 can supply predetermined power to the converter 80*f* via the driver IC 33.

The plurality of data lines 32 are wirings in a straight shape extended and arranged in a vertical direction of paper and are formed to be extended and arranged over the effective display region V from the extended region 36. The respective data lines 32 are formed at a constant distance in X direction to electrically connect to the corresponding TFT elements 21, respectively. The respective TFD elements 21 are connected to the corresponding pixel electrodes 10, respectively.

The plurality of wirings 31 is configured of main electric wires 31*a* and curved portions 31*b* that are curved from the end of the main electric wires 31*a* to the side of the seal material 3. The respective main electric wires is formed to be extended and arranged in Y direction from the region 36 extended through the picture frame region 38. The one end of the respective curved portions 31*b* is positioned in the seal material 3 existing left of paper or right of paper so that it is electrically connected to the conducting member 7 incorporated in the seal material 3.

The circuit configuration having the color filter substrate 92 will now be described as follows.

As shown in FIG. 6, the color filter substrate 92 has the plurality of scan lined 8 in the rectangular shape extended and arranged in X direction. The left end or the right end of the respective scan lines 8 is positioned in the seal material 3 as shown in FIG. 3 and FIG. 6 so that it is electrically connected to the conducting member 7 in the seal material 3.

As described above, the cladding state formed by interposing the seal material 3 between the color filter substrate 92 and the element substrate 91 is shown in FIG. 3. As shown in FIG. 3, the respective scan lines 8 of the color filter substrate 92 are approximately orthogonal to the respective data lines of the element substrate 91 so that they are two-dimensionally overlapped with the plurality of pixel electrodes 10. Accordingly, the overlapped region of the scan lines 8 and the pixel electrodes 10 constitutes the sub-pixel region SG.

Further, the scan lines 8 of the color filter substrate 92 and the wirings of the element substrate 91 are alternatively overlapped between the left side and the right side thereof so that the scan lines 8 and the wirings 31 are conducted up and down by interposing the conducting member 7 in the seal material 3. That is, the conduction of the respective scan lines 8 and the respective wirings 31 is realized between the left side and the right side thereof. In accordance with this, the scan lines 9 of the color filter substrate 92 are electrically connected to the driver IC 33 by interposing the wirings 31 of the element substrate 91 therebetween.

The specific acting effects according to the embodiment of the invention are described below with reference to the comparison example.

Figure 7:
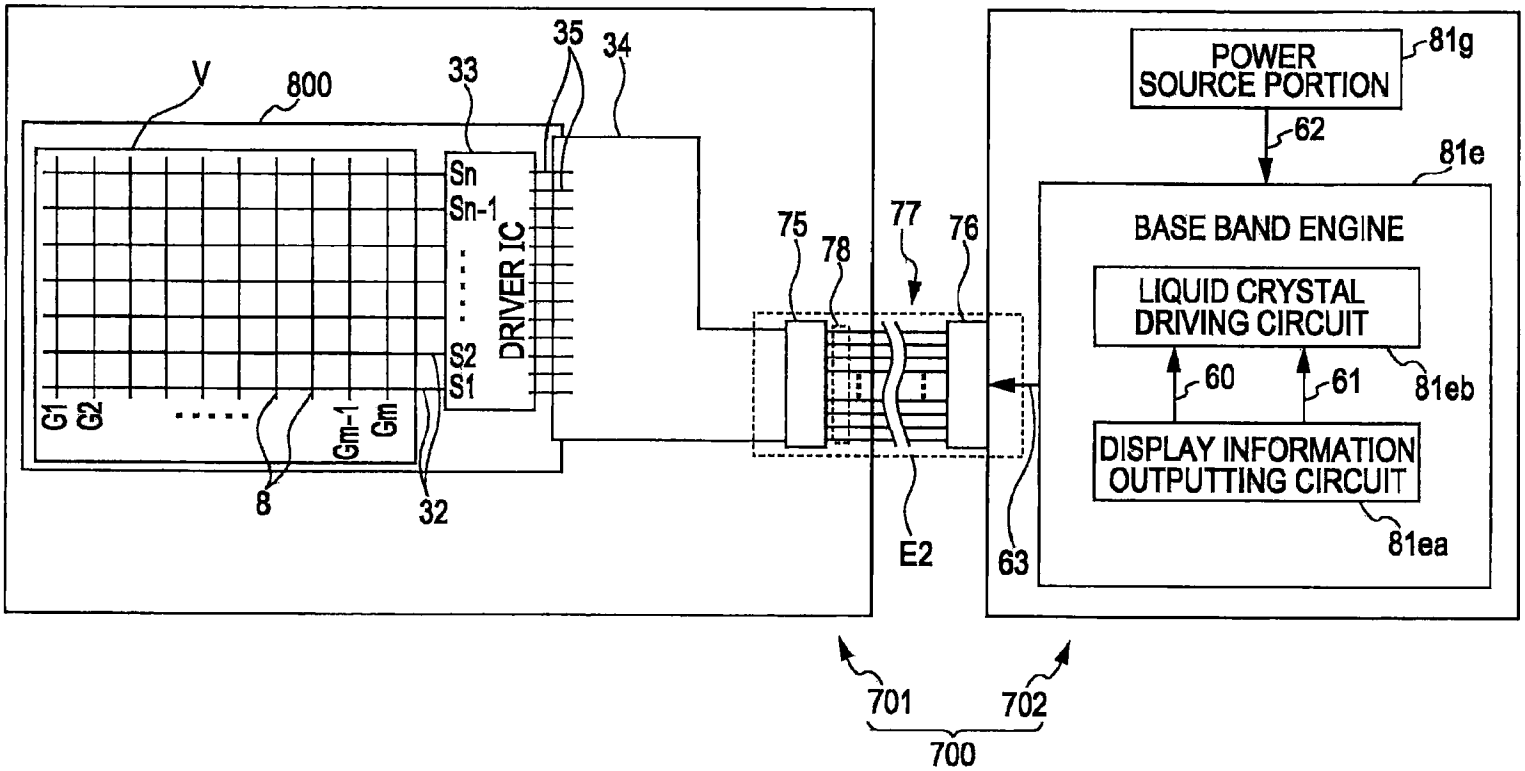
FIG. 7 Prior Art
FIG. 7 shows a block diagram of a circuit configuration of a mobile phone according to a comparison example.

First, the configuration of the mobile phone 700 according to the comparison example will briefly be described with reference to FIG. 7. Further, same reference numerals are designated to the same components as the embodiments, and the description thereof will be simplified or omitted.

The mobile phone 700 is constituted by including a display unit 701 and a body portion 702.

The display unit 701 comprises a liquid crystal device 800, FPC 34 electrically connected to a driver IC 33 provided in the liquid crystal device 800 by interposing the plurality of external connection wiring 35 therebetween, and a connector 75 provided in the one end of the FPC 34.

Herein, although the liquid crystal device 800 has the almost same configuration as that of the liquid crystal device 50 according to the embodiments, the liquid crystal device 800 is not provided with the power source portion 70. Further, the FPC 34 is not provided with the converter 80*f* having the transceiving antenna 80*h* according to the embodiments. Instead, in the comparison example, the FPC 34 is provided with a connector 75. On the other hand, the body portion 81 comprises a baseband engine 81*e*, a power source portion 81*g* and a connector 76, which are the same configurations as the embodiments. However, the body portion 81 is not provided with the converter 81*f* having the transceiving antenna 81*h* according to the embodiments. The connector 75 of a display unit 701 is electrically connected to the connector 76 of a body portion 702 via a plurality of wirings 77. The plurality of wirings 77 comprise various wirings such as potential supply wirings and ground wirings configuring power source lines, display data signal supplying wirings, and display controlling signal supplying wirings such as horizontal synchronizing signals, vertical synchronizing signals, or dot clock signals, etc. On the one end side of the plurality of the wirings 77 positioned in the connector 75 side of the display unit 701 a noise removing filter 78 is provided. The filter is used for removing noises, if the noises generated in the mobile phone 77 enter the various wirings 77.

The driving method of the mobile phone 700 according to the comparison example will now be described.

First, based on operating instructions from operating keys by a user, if the display data signals 60 and the display controlling signals 61, respectively, are obtained from a the information outputting circuit 81*ea*, the liquid crystal driving circuit 81*eb* outputs various signals 63 such as data signals, clock signals and vertical synchronizing signals, etc. to the connector 76, the plurality of wirings 77, the noise removing filter 78, the connector 75, the FPC 34, and the driver IC 33 by interposing the plurality of the external connecting wirings 35, respectively. Herein, as a method of transmitting various signals, known transmission methods such as, for example, a serial transmission method, a parallel transmission method capable of transmitting signals in higher speed such as several tens M bits/second over a general serial transmission method, or a low voltage differential signaling transmission method of transmitting signals in higher speed such as several hundreds M bits/second may be included. Next, the driver IC supplies the image signals to the plurality of data lines 32 based on the clock signals included in the various signals 63 and sequentially scans the plurality of scan lines 8 based on the clock signals and the vertical synchronizing signals included in the various signals 63. In accordance with this, the effective display region, that is, the display portion (not shown) of the display unit 710 can display desired characters and images.

In the comparison example of the configuration, the communication portion of the display unit 701 and the body portion 702, that is, the interface portion (a broken line portion in a spherical shape) is constituted with the plurality of wirings 77, that is, wires.

For this reason, various constraints in designing the mobile terminal apparatus 700 are involved, such as a space for installing the plurality of wirings 77 must be secured or the layout method of the plurality of wirings 77 must be changed according to the specification or kind of the mobile terminal apparatus, etc. Therefore, the degree of freedom of the design of the interface portion E2 is degraded and also it is difficult to realize the miniaturization and lightweight of the mobile terminal apparatus 700.

Further, since there are various different wirings or various different circuits in the mobile terminal apparatus 700, noises generated therefrom enter the plurality of wirings 77 and therefore, there is considerable risk of not obtaining a desired image. That is, although the noise removing filter 78 is provided on the plurality of wirings 77, the interference problems due to the noises generated among the plurality of wirings 77, other plurality wirings, and various circuits are not completely solved.

Also, only the body portion 702 is provided with the power source portion 81*g* in the comparison example. For this reason, the power source portion 81*g* supplies power a liquid crystal device mounted on the display unit 701 side in addition to the baseband engine 81*e* and therefore, it is difficult to realize the reduction of power consumption.

At this time, in this mobile phone 100 having the liquid crystal apparatus 50 according to the embodiments, the communication portion of the display unit 80 and the body portion 81, that is, the interface portion E1 (a broken line portion in a spherical shape in FIG. 2) is provided with the converter 80*f* having the transceiving antenna 80*h* and the converter 81*f* having the transceiving antenna 81*h* and the interface portion E1 is constituted by the wireless rather than the wire as indicated in the comparison example.

In accordance with this, the interface portion E1 in the mobile phone can be simplified. That is, it is unnecessary to install the plurality of wirings or the noise removing filter in the interface portion E1. Therefore, the degree of freedom of the design of the peripheral of the supporting apparatus, that is, the degree of freedom of the design of the interface portion can be improved as well as the degree of freedom of the design of the liquid crystal device 50 and the mobile phone 100 can be improved. Consequently, the miniaturization and lightweight of the liquid crystal apparatus 50 and the mobile phone 100 can be realized.

Also, the display unit 80 and the body portion 81 are detachably mounted to each other by the supporting apparatus 81*b* and therefore, if necessary, the display unit 80 can be detached from the body portion 81.

Further, it is possible to execute a two-way communication between the converter 80*f* of the display unit 80 and the converter 81*f* of the body portion 81 so that the reliability (for example, existence or non-existence of errors) of data upon transceiving the data is investigated by the two-way communication to correct the errors, etc., thereby improving the reliability of communication.

Accordingly, if they can be realized, the variation of the usage of the mobile phone 100 can be widen as follows, for example: a user carries only the display unit 80 in order to allow the user to view display images such as call states of a mail and a phone, etc. at any time while putting the body portion in the user's pocket except when the user operates the body portion; a user operates the operating keys 81*c* of the body portion 81 and then uses only the display unit 80 to transmit predetermined radios to a key system of the front door so that the user can electronically open and shut the key of the front door; or a user operates the operating keys of the body portion 81 and then approaches only the display unit 80 to the electronic payment system mounted on an automatic vending machine or a counter, etc. to transmit predetermined radios to the electronic payment system so that the user can make an electronic payment (electronic money function), etc.

Also, in the aspects according to the embodiments, the transmission and reception of the wireless signals 64 is executed between the converter 80*f* having the transceiving antenna 80*h* of the display unit 80 and the converter 81*f* having the transceiving antenna 81*h* of the body portion 81 using frequency bands not to be overlapped with frequency bands for a communication and the transmission and reception of a mail. Thereby, it is difficult that various unnecessary noises generated in the mobile phone 100 enter the wireless signals 64 corresponding to the display data signals 60 and the display controlling signals 61. Also, when the transmission and reception of a communication and a mail using the mobile phone 100 is executed while executing the transmission and reception of the wireless signals 64 corresponding to the display data signals 60 and the display controlling signals 61 between the converter 81*f* in the body portion 81 and the converter 80*f* in the display unit 80, it can prevent unnecessary noises generated upon making the communication and the transmission and reception of the mail from entering the wireless signals 64 corresponding to the display data signals 60 and the display controlling signals 60. Therefore, the interference problems due to the noises involved in the transmission of the wireless signals corresponding to the display data signals 60 and the display controlling signals 61 can be solved.

Further, in the aspects according to the embodiments, the wireless transmission method may be a serial transmission method. It is preferable that each of the display data signals 60 and the display controlling signals 61 is converted into packetized wireless signals by the serial transmission method and the transmission and reception of the wireless signals is intermittently executed between the converter 81*f* in the body portion 81 and the converter 80*f* in the display unit 80. By intermittently executing the transmission and reception of the display data signals 60 and the display controlling signals 61, the reduction of the power consumption of the mobile phone can be realized.

In addition, according to the embodiments, the body portion 81 is provided with the power source portion 81*g* and the display unit 80 is provided with a separate power source portion 70 independently of the power source portion 81*g*. Thereby, compared with the comparison example, the lifetime of the power source portion 81*g* and the power source portion 70 can be improved about twice so that the reduction of power consumption can be realized. Thereby, it is preferable that only the display data signals and the display controlling signals are transmitted from the baseband engine 81*g* in the body portion 81 to the display unit 80 so that high speed wireless communication can be realized.

Modified Example

Figure 8:
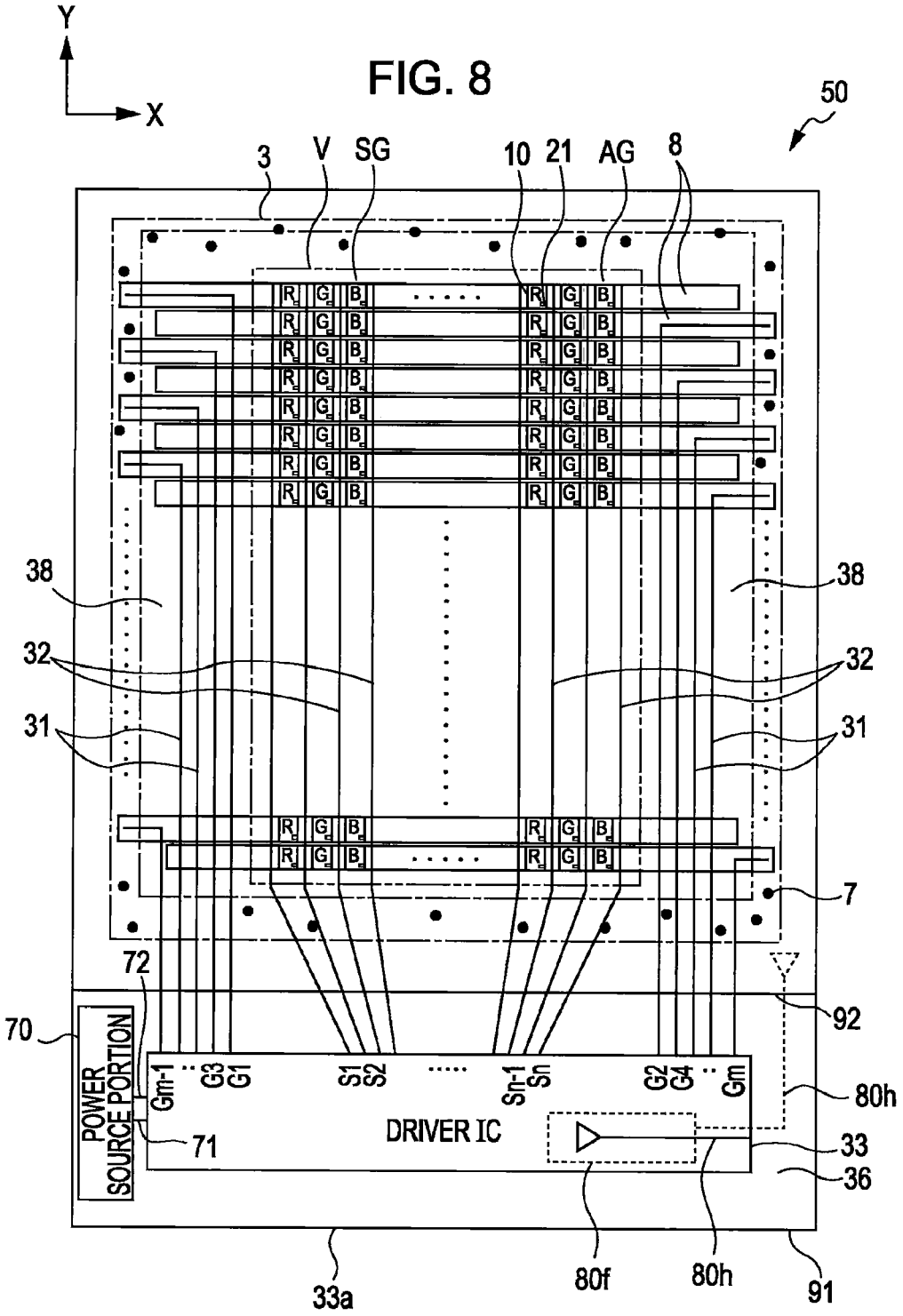
FIG. 8 diagrammatically shows a block diagram of a configuration of a liquid crystal device according to a modified example.

According to the embodiments, the FPC 34 that is electrically connected to the driver IC 33 mounted to the extended region 36 of the element substrate 91 is provided with the converter 80*f* having the transceiving antenna 80*h*. The invention is not limited thereto. According to the invention, as shown in FIG. 8, it may be constituted to mount the converter 80*f* to the driver IC 33 of the element substrate 91 as a circuit (a broken line portion of a rectangular shape) so that it is provided to be drawn out on the outer face 33*a* of the driver IC 33 in order to indicate the transceiving antenna 80*h* extending from the converter 80*f* by a real line or to be drawn out on the lower substrate 1 in order to indicate the transceiving antenna 80*h* by a broken line. Thereby, since it is unnecessary to install the FPC 34, etc., the degree of freedom of the liquid crystal device 50 and the mobile phone 100 can be improved as well as the miniaturization and lightweight of the liquid crystal device 50 and the mobile phone 100 can be realized.

Further, according to the embodiment, the power source portion 70 is to be provided in the region 36 extending from the lower substrate 1 and the position near the driver IC 33, however, according to the invention, a setting position of the power source portion 70 is not limited except the effective displaying region V.

Also, according to the embodiment, although the supporting apparatus 81*b* having a function to detachably mount the display unit 80 and the body portion 81 is to be provided in the body portion 81, the invention is not limited thereto, but may install the supporting apparatus 81*b* in the display unit 80 or both the body portion 81 and the display unit 81.

In addition, according to the embodiment, although the invention is applied to the transmission type liquid crystal device 50, the invention is not limited thereto, but may be applied to a reflective type or a transflective type liquid crystal device. Also, according to the embodiment, although the invention is applied to the liquid crystal device having the TFD element 21 as one example of a two terminal type nonlinear element, the invention is not limited thereto, but may be applied to a liquid crystal device having a three terminal type element represented by a P—Si type TFT element or α-Si type TFT element.

Moreover, the various modifications can be made without departing from the scope of the invention.

Electronic Apparatus

Figure 9:
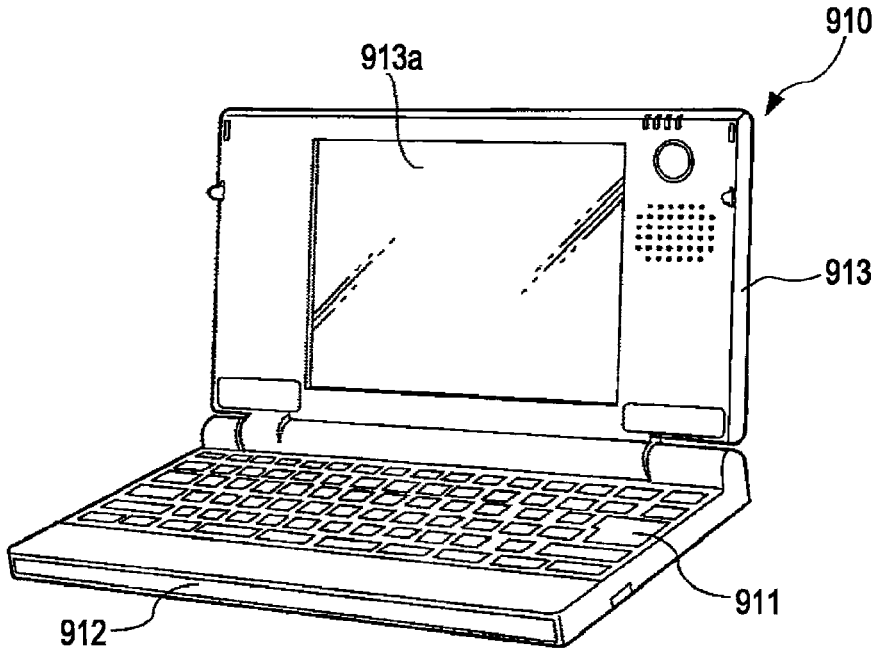
FIG. 9 shows a perspective diagram of an electronic apparatus using a liquid crystal device according to an aspect of the invention.

The concrete example of the electronic apparatus to which the liquid crystal device 50, etc. according to the embodiments and the modified examples can be applied will now be described with reference to FIG. 9.

First, an example applying the liquid crystal device 50, etc according to the invention to a display portion of a transportable personal computer (so called a notebook computer) will be described. FIG. 9 shows a perspective diagram of the configuration of the personal computer. As shown in FIG. 9, the personal computer 910 comprises a body portion 912 having a keyboard 911; and a display unit 913 to which the liquid crystal device 50 according to the embodiments is applied. Also, although not shown, the body portion 912 and the display unit 913 are detachably mounted to each other by a supporting apparatus (not shown). The body portion 912 has the same circuit configuration as the body portion 81 in the mobile phone 100 and the display unit 913 has the same circuit configuration as the display unit in the mobile telephone 100. Also, it is constituted to execute the transmission and reception of wireless signals such as image data, etc. between the body portion 912 and the display unit 913 based on a wireless transmission method. For this reason, the personal computer 910 can obtain the acting effect of the invention as described above.

Further, as an electronic apparatus to which the liquid crystal device 50 according to the embodiments can be applied, in addition to the personal computer in shown in FIGS. 1A and 1B or the mobile phone 110 in shown in FIGS. 1A and 1B, a portable information terminal such as a personal digital assistant (PDA), a liquid crystal TV, a viewfinder type and a monitor direct viewing type video tape recorder, a car navigation device, a pager, an electronic notebook, a calculator, a word processor, a workstation, a video phone, a POS terminal, a digital still camera, etc. may be included.

What is claimed is:

1. An electronic apparatus comprising:

a display portion including:

(a) a display unit configured to display images;

(b) a first power source configured to supply power;

(c) an external communication radio frequency (RF) antenna configured to transmit and receive signals to and from a base station using a first frequency band;

(d) a first converter which includes a first RF antenna, the first converter being configured to:

(i) intermittently execute reception of packetized wireless signals including display control signals and image signals from outside of the display portion using a wireless transmission method operating in a second frequency band, wherein the first frequency band and the second frequency band are non-overlapping; and (ii) convert the packetized wireless signals received via the first antenna into clock signals, horizontal synchronizing signals, and vertical synchronizing signals; and (e) a driving circuit that is electrically connected to the first power source and the first converter, the driving circuit being configured to display the images on the display unit based on: (i) the power supplied from the first power source; (ii) the image signals; (iii) the clock signals; (iv) the horizontal synchronizing signals; and (v) the vertical synchronizing signals; and a body portion including:

(a) a second converter which includes a second RF antenna, the second converter being configured to:

(i) convert the image signals and the display control signals into the packetized wireless signals; and (ii) intermittently execute transmission of the packetized wireless signals between the body portion and the first converter using the wireless transmission method operating in the second frequency band, wherein the wireless transmission method is a serial transmission method that is only intermittently executed to transmit the packetized wireless signals;

(b) a controlling circuit configured to:

(i) generate the image signals and the display control signals; and (ii) output the image signals and the display control signals to the second converter; and (c) a second power source configured to supply power to the second converter and the controlling circuit, wherein the second power source is always electrically isolated from the first power source, wherein each intermittently executed transmission and reception of packetized wireless signals includes only the image signals, the clock signals, the horizontal synchronizing signals, and the vertical synchronizing signals, and wherein the body portion and the display portion are configured to be detachably mounted to each other, the body portion is configured to fit inside a pocket of a user, and when the body portion is located inside the pocket of the user and the display portion is located outside the pocket of the user, the display portion is configured to intermittently receive the packetized wireless signals from the body portion located inside the pocket of the user.

2. The electronic apparatus of claim 1, further comprising a wiring board that is connected to the driving circuit, wherein the first converter is provided on the wiring board.

3. The electronic apparatus of claim 1, wherein the first power source comprises:

a power source portion that can be charged by contact-less charging based on electromagnetic induction; and a power supply circuit that supplies power obtained from the power source portion to the first converter and the driving circuit.

4. The electronic apparatus of claim 1, further comprising:

a plurality of first wires that are electrically connected to the driving circuit to output data signals from the driving circuit;

a plurality of second wires that are electrically connected to the driving circuit and arranged so as to intersect the plurality of first wires to output scan signals from the driving circuit; and a plurality of pixel electrodes that are arranged at intersections of the plurality of first wires and the plurality of second wires and electrically connected to the plurality of first wires, wherein the display portion corresponds to a region in which the plurality of pixel electrodes are disposed.

5. The electronic apparatus of claim 1, wherein:

(a) the first converter is configured to:

(i) convert wire signals from the driving circuit into second wireless signals; and (ii) transmit the second wireless signals to the outside of the display portion via the first RF antenna; and (b) the second converter is configured to:

(i) receive the second wireless signals via the second RF antenna;

(ii) convert the second wireless signals into second wire signals; and (iii) output the second wire signals to the controlling circuit.

6. The electronic apparatus of claim 1, wherein the packetized wireless signals transmitted by the second converter only include the image signals and the display control signals.

7. The electronic apparatus of claim 1, wherein the display unit includes a display region where the images are displayed, and the first power source is provided in a region of the display unit that does not overlap the display region.

8. The electronic apparatus of claim 7, wherein the display unit is a transmission type display.

9. The electronic apparatus of claim 7, wherein the display unit is a reflective type display.

10. The electronic apparatus of claim 1, wherein the display unit includes a display region where the images are displayed, and the first power source is provided in a region of the display unit that overlaps the display region.

11. The electronic apparatus of claim 1, wherein the first power source and the second power source are each configured to be charged by a contact-less type charging method.

* * * * *